US009955848B2

(12) United States Patent
Gadini et al.

(10) Patent No.: US 9,955,848 B2
(45) Date of Patent: May 1, 2018

(54) WASHING-AGENT DISPENSER FOR HOUSEHOLD WASHING MACHINES, IN PARTICULAR DISHWASHERS

(71) Applicant: ELTEK S.p.A., Casale Monferrato (Alessandria) (IT)

(72) Inventors: Costanzo Gadini, Casale Monferrato (IT); Daniele Cerruti, Casale Monferrato (IT)

(73) Assignee: ELTEK S.P.A., Casale Monferrato (Alessandria) (IT)

( * ) Notice: Subject to any disclaimer, the term of this patent is extended or adjusted under 35 U.S.C. 154(b) by 370 days.

(21) Appl. No.: 14/902,839

(22) PCT Filed: Jul. 3, 2014

(86) PCT No.: PCT/IB2014/062827
§ 371 (c)(1),
(2) Date: Jan. 4, 2016

(87) PCT Pub. No.: WO2015/001511
PCT Pub. Date: Jan. 8, 2015

(65) Prior Publication Data

US 2016/0192820 A1 Jul. 7, 2016

(30) Foreign Application Priority Data

Jul. 4, 2013 (IT) ..... TO2013A0562

(51) Int. Cl.
*A47L 15/44* (2006.01)
*D06F 39/02* (2006.01)

(52) U.S. Cl.
CPC ..... *A47L 15/4409* (2013.01); *D06F 39/02* (2013.01)

(58) Field of Classification Search
CPC ..... A47L 15/4409
See application file for complete search history.

(56) References Cited

U.S. PATENT DOCUMENTS 5,884,821 A 3/1999 Wilhelmstaetter et al.
2005/0115595 A1* 6/2005 Cerruti ..... A47L 15/4409 134/93

FOREIGN PATENT DOCUMENTS

DE 10 2005 004098 A1 8/2005
EP 0 780 087 A2 6/1997

OTHER PUBLICATIONS

Written Opinion and International Search Report for International Application No. PCT/IB2014/062827, dated Nov. 21, 2014.

* cited by examiner

*Primary Examiner* — Jason Ko
(74) *Attorney, Agent, or Firm* — Heslin Rothenberg Farley & Mesiti P.C.

(57) ABSTRACT

A washing agent dispenser for machines for washing includes a dispenser body with a receptacle for containing a washing agent, a lid having a lid body mounted in a guided way with respect to the dispenser body for being movable between a position of closing and a position of opening of the receptacle, and sliding guides between the dispenser body and the lid body. The sliding guides include: a first guiding element and a first guided element; and a second guiding element and a second guided element. At least one of the dispenser body and the lid body includes at least one constraint element, which is additional to the first walls and second walls and is pre-arranged for limiting displacements of the guided elements with respect to the guiding elements in a direction generally transverse to a direction of sliding of the lid determined by the sliding guides.

18 Claims, 13 Drawing Sheets

Fig. 9
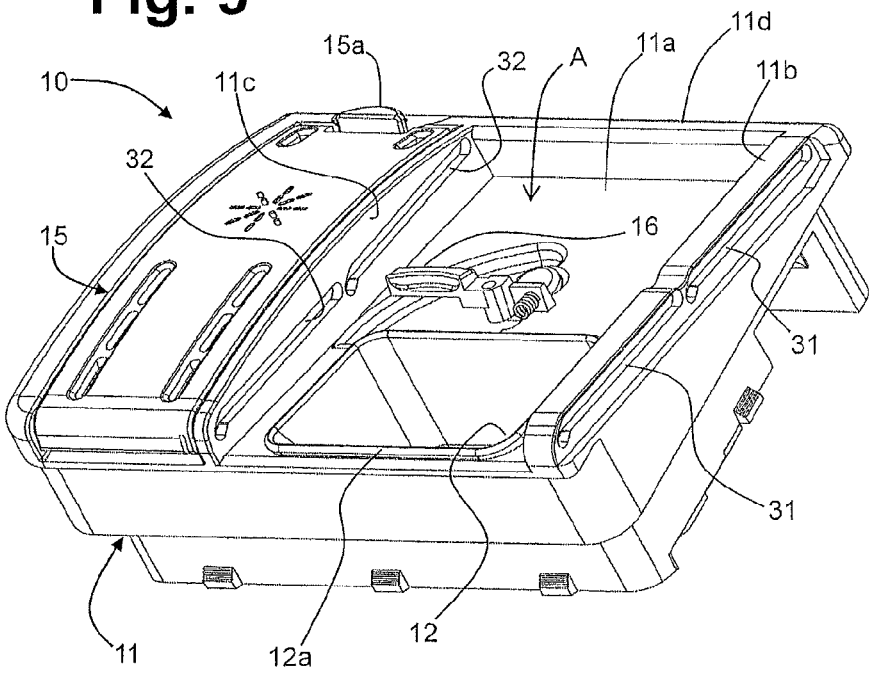
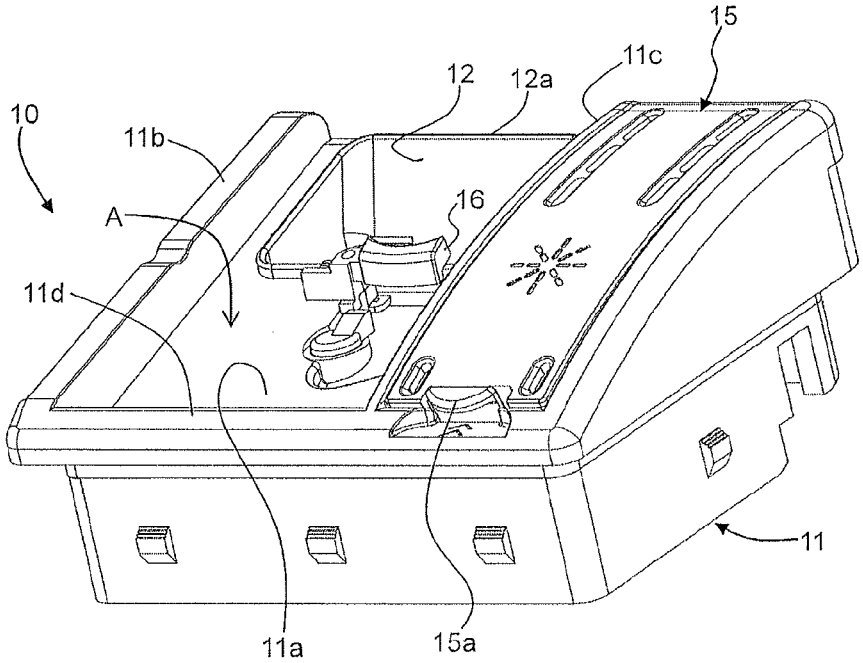
Fig. 10

Fig. 11
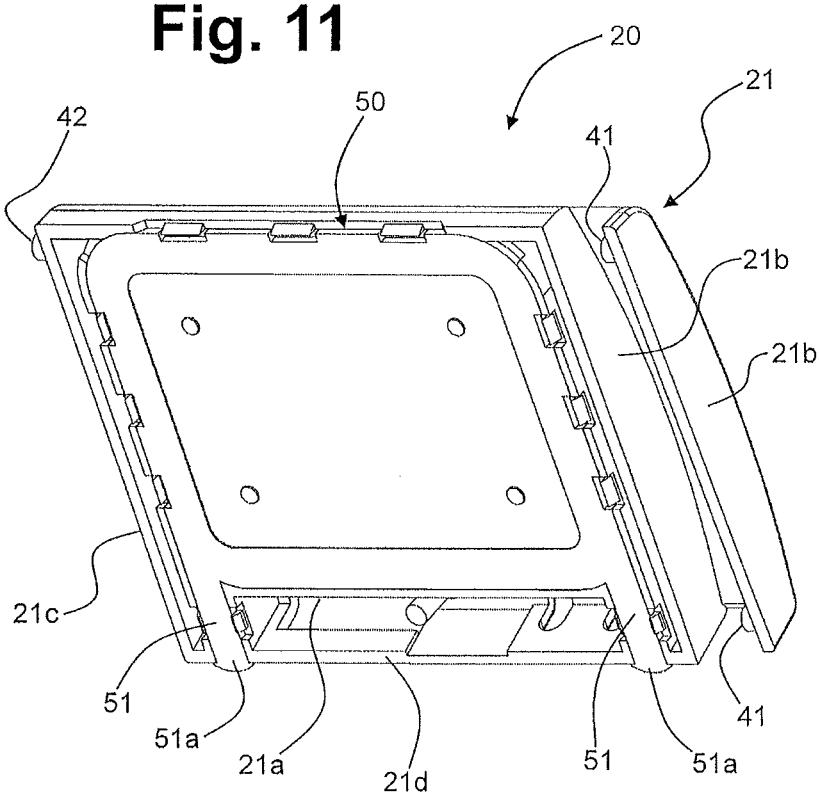
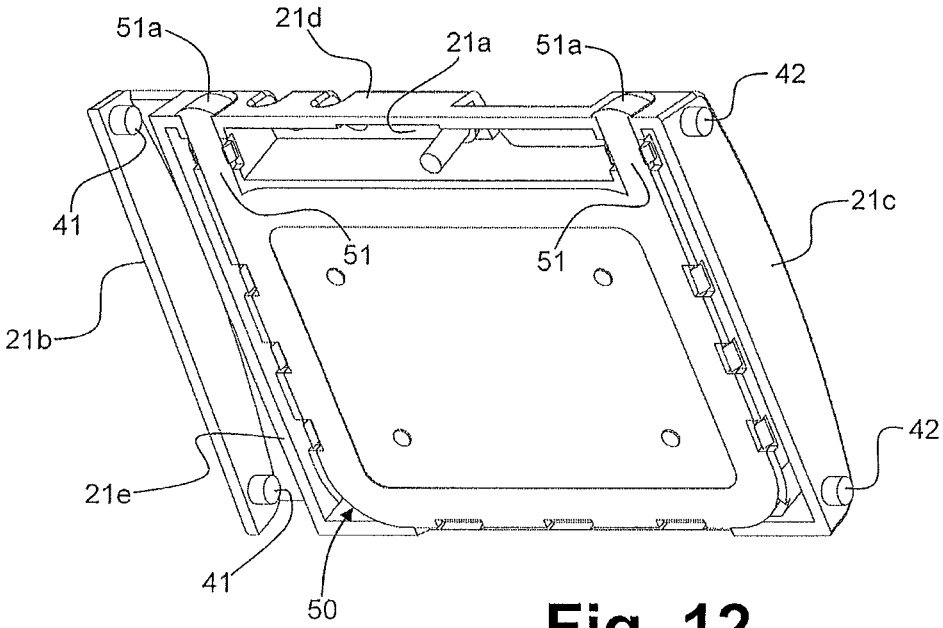
Fig. 12

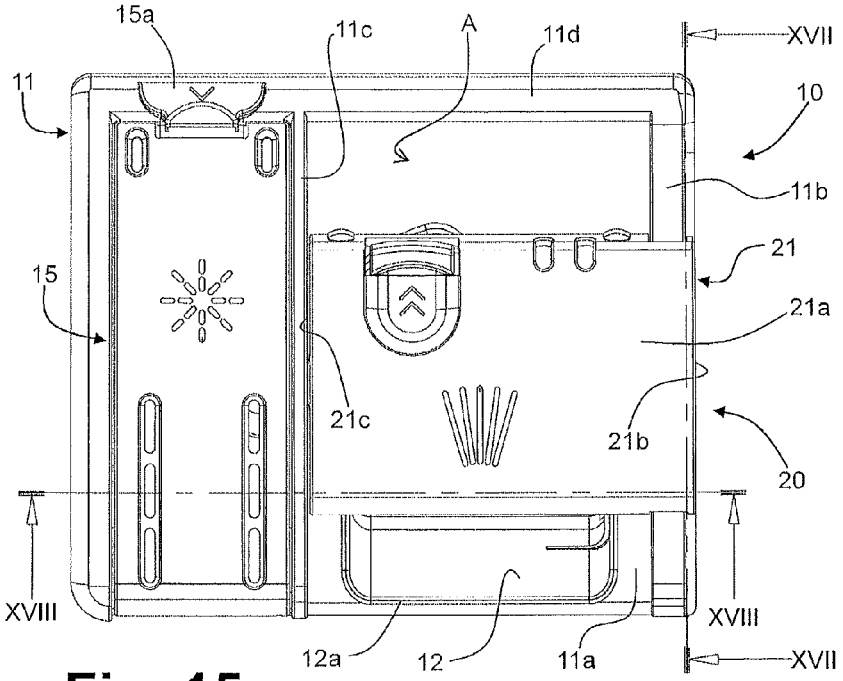
Fig. 15
Fig. 16
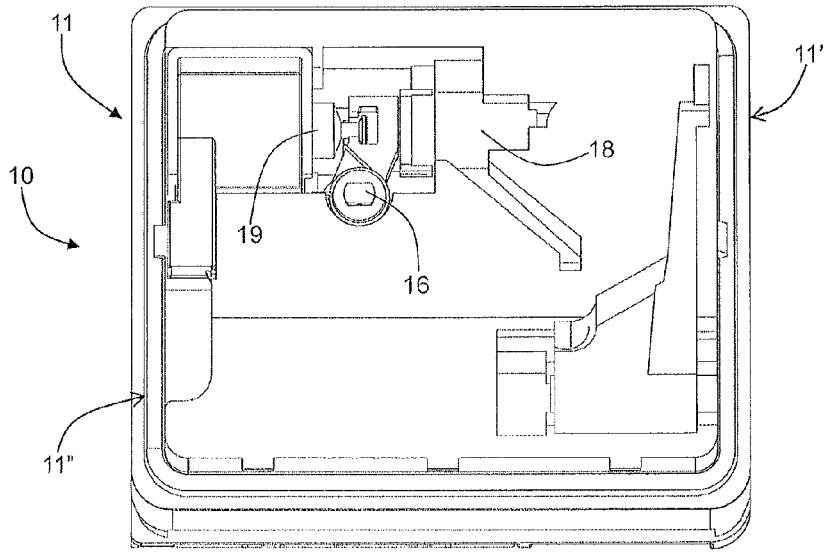

WASHING-AGENT DISPENSER FOR HOUSEHOLD WASHING MACHINES, IN PARTICULAR DISHWASHERS

CROSS REFERENCE TO RELATED APPLICATIONS

This application is a national stage filing under section 371 of International Application No. PCT/IB2014/062827, filed on Jul. 3, 2014, and published in English on Jan. 8, 2015, as WO 2015/001511 A1, and claims priority of Italian application No. TO2013A000562 filed on Jul. 4, 2013, the entire disclosure of these applications being hereby incorporated herein by reference.

FIELD OF THE INVENTION

The present invention relates to dispensers of washing agents for household machines for washing, in particular dishwashers, and has been developed with particular reference to dispensers equipped with at least one sliding lid.

PRIOR ART

Some household machines for washing, and in particular dishwashers, are provided with a device for dispensing washing products that is configured for dispensing at least one washing agent. Generally, these devices are provided for dispensing, at different moments of one and the same dish-washing cycle, two different washing agents, typically represented by a washing agent in solid form (in powder or tablet form) and by a liquid rinsing additive. Also known are dispensers provided for dispensing a single washing substance in solid form or else in liquid form.

In the most widespread solutions, dispensers for dishwashers comprise a main body obtained by moulding of thermoplastic material, associated to one of the vertical walls that delimit the washing tank of the machine (including the inner shell of the front door of the machine that faces the inside of the washing tank), usually at least partially set-in in a fluid-tight way in an opening provided in the aforesaid wall. Defined in the front area of the body of the dispenser is a receptacle for containing a washing agent, usually a washing agent in powder or tablet form, necessary for carrying out a washing cycle. The receptacle is provided with a closing lid, which also has a respective body made of plastic material. Operative between the body of the dispenser and the body of the lid are elastic means, which force the lid towards a respective open position, as well as a system for blocking/release of the lid. In the course of a washing cycle, opening of the aforesaid lid is appropriately controlled by a programmer, or timer, of the machine, which controls an actuator forming part of the aforesaid blocking/release system; the latter is usually devised also for enabling, when the machine is not in operation, manual opening and closing of the lid.

In some known solutions, the body of the lid is slidably constrained to the body of the dispenser in order to be able to slide between a closed position and an open position in a substantially linear way or else following a path at least in part inclined or curved. For this purpose, corresponding sliding guides are provided, which interact between the body of the dispenser and the body of the lid. Devices of this type are known, for example, from U.S. Pat. No. 5,884,821 A and DE102005004098 A, on which the preamble of Claim 1 is based.

The solution according to U.S. Pat. No. 5,884,821 A is schematically exemplified in FIG. 1, where the known dispenser is designated as a whole by 1 and where the bodies of the lid and of the dispenser are designated by 2 and 3, respectively. The body 2 of the lid has two opposite portions, which are constituted by walls 2*a* and 2*b* generally parallel to one another and to the direction of sliding of the lid (here substantially perpendicular to the plane defined by the sheet of the drawing). The body 3 of the dispenser has two corresponding opposite portions or walls 3*a* and 3*b*, generally parallel to one another and to the aforesaid walls 2*a*, 2*b* of the body 2 of the lid, where the internal side of each of the walls 2*a*, 2*b* faces the external side of a corresponding wall 3*a*, 3*b*. Provided at the internal side of each of the walls 2*a*, 2*b* is at least one projecting element 2*a*', 2*b*', which is slidably engaged in a guiding groove 3*a*', 3*b*' defined at the external side of the corresponding wall 3*a*, 3*b*.

Likewise, the solution according to DE102005004098 A envisages an arrangement distinguished by pairs of portions or walls of the body of the dispenser and of the body of the lid that are generally parallel to one another and to the direction of sliding of the lid. This known solution is exemplified schematically in FIG. 2, where the same reference numbers as those appearing in FIG. 1 are used to designate elements that are technically equivalent to the ones already described. As may be noted, in this case, it is the external side of each of the walls 2*a*, 2*b* of the body 2 of the lid that faces the internal side of the corresponding wall 3*a*, 3*b* of the body 3 of the dispenser, where provided at the external side of each of the walls 2*a*, 2*b* is the at least one projecting element 2*a*', 2*b*' that is slidably engaged in the guiding groove 3*a*', 3*b*' defined at the internal side of the corresponding wall 3*a*, 3*b* of the body 3.

Dispensers provided according to the solutions known from the documents referred to above are particularly sensitive to dimensional tolerances of production, which may cause risks of jamming or rocking of the corresponding lids, above all if it is taken into account that pre-set clearances between the facing walls provided with the sliding guides (grooves and projecting reliefs) are relatively modest, generally with a maximum tolerance of ±0.1 mm, with respect to a predefined value.

Usually, moulding with thermoplastic material of a dispenser body and of a corresponding lid body envisages the use of moulds having cavities or impressions of dimensions greater than the nominal dimensions of the components in question. In practice, these cavities are purposely "oversized"; i.e., they are designed taking into account an expected shrinkage of the thermoplastic material, this shrinkage consisting in a dimensional variation in reduction of the material, which is due to its cooling and to its hardening after the moulding step. This shrinkage, however, varies according to the type of material (the characteristics of which may differ to a certain extent from one producer of the row material to another) and according to other process parameters, which are also potentially subject to variations due to a wide range of factors (for example, ambient temperature, extrusion rate, etc.).

Considering the known solutions cited, FIG. 1 described above represents schematically an optimal nominal size of the end product, i.e., with an expected shrinkage of the thermoplastic material without any deformation, in the case of the lid of a dispenser according to U.S. Pat. No. 5,884,821 A. An excessive shrinkage of the thermoplastic material may, however, cause a final width of the body of the lid that is smaller than the nominal width, and hence, as such, insufficient to guarantee correct sliding of its projecting parts in the guiding groove. Such a case is represented schematically in FIG. 3, where, following upon assembly of the parts, the elements 2*a*', 2*b*' and/or the walls 2*a*, 2*b* of the body of the lid 2 end up being, respectively, forced in the grooves 3*a*', 3*b*' and/or against the corresponding walls 3*a*, 3*b* of the body 3 of the dispenser, with a consequent jamming of the lid or in any case a movement with excessive friction during its travel. On the other hand, an insufficient shrinkage of the thermoplastic material may determine a final width of the body 2 of the lid that is excessive with respect to the nominal value, with the consequence that the elements 2*a*', 2*b*' rock laterally in the grooves 3*a*', 3*b*'. Such a case is represented schematically in FIG. 4 where, following upon assembly, the elements 2*a*', 2*b*' are excessively loose in the grooves 3*b*, with consequent excessive lateral deviation of the body of the lid during its travel of sliding. An excessive or insufficient shrinkage of the material of the body 2 of the lid could unfavourably combine with opposite phenomena of insufficient or excessive shrinkage of the material of the body 3 of the dispenser, further accentuating the aforesaid conditions of jamming or rocking movement of the lid.

Consequences similar to the ones described above arise also in case of an anomalous shrinkage of the thermoplastic material during production of a dispenser according to DE102005004098 A. FIG. 2 described above exemplifies an optimal nominal dimension of the product, i.e., following upon an expected shrinkage of the thermoplastic material, whereas FIGS. 5 and 6 highlight a case of anomalous shrinkage of the material. The case of an excessive shrinkage of the material of the body 2 of the lid is exemplified in FIG. 5, where, following upon assembly, the elements 2*a*', 2*b*' are excessively loose of the grooves 3*a*', 3*b*', with consequent excessive lateral deviation of the body 2 of the lid, whereas the case of insufficient shrinkage of the thermoplastic material is exemplified in FIG. 6, where, following upon assembly, the elements 2*a*', 2*b*' and/or the walls 2*a*, 2*b* of the body 2 end up being forced in the grooves 3*a*', 3*b*' and/or against the walls 3*a*, 3*b* of the body 3, with consequent jamming or in any case with excessive friction.

It should also be considered that the aforesaid faults due to jamming or excessive lateral deviation of the lid may depend also upon further dimensional tolerances that can be put down to deformation of the structure, such as warping of the walls that support the elements 2*a*', 2*b*', which add to the aforesaid tolerances due to shrinkages of the plastic material different from the expected values.

A lateral deviation of the lid may possibly be acceptable in the perspective of enabling proper operation of the dispenser, but results in a very poor quality of the product perceived above all by the end user. Dispensers that are subject to jamming or excessive friction between the lid and the body of the dispenser cannot evidently be put on the market, with consequent rejects and need for re-working.

AIM AND SUMMARY OF THE INVENTION

An aim of the present invention is basically to solve the aforesaid drawbacks. In this perspective, according to a first aspect, the present invention proposes providing a dispenser of washing agents in which the risks of deviations or excessive lateral movements of the lid in the course of its sliding travel, following upon assembly of the end product, are eliminated or at least reduced to a substantial extent. According to a second aspect, the present invention proposes providing a dispenser of washing agents in which the risks of jamming or excessive friction between the lid and the body of the dispenser, following upon assembly of the end product, are eliminated or at least reduced to a substantial extent.

A further aim is to provide a dispenser of washing agents having a structure designed to facilitate moulding and/or assembly of parts of the dispenser itself, and in particular of its lid and/or the corresponding guides.

The above and other aims still, which will emerge more clearly hereinafter, are achieved according to the present invention by a dispenser of washing agents presenting, amongst other things, the characteristics indicated also in the claims. The aims the invention are moreover achieved by a machine for washing, in particular a dishwasher, including a dispenser of the above sort.

In a preferential version, the invention regards a dispenser of washing agents that comprises:

- a dispenser body obtained by moulding of thermoplastic material, with at least one receptacle for containing a washing agent;
- at least one lid having a lid body obtained by moulding of thermoplastic material, movable in a guided way on the dispenser body between a position of closing and a position of opening of the at least one receptacle;
- sliding guides for constraining the lid body with respect to the dispenser body; and
- a system for blocking/release of the lid;

wherein a first wall and a second wall of the dispenser body are generally opposite to each other, and a first wall and a second wall of the lid body are generally opposite to each other, with mutually facing sides of the first walls that are preferably generally parallel to each other and to mutually facing sides of the second walls, wherein the sliding guides comprise:

- at least one first guiding element and at least one first guided element, in particular on mutually facing sides of a first wall of the dispenser body and of a first wall of the lid body, respectively;
- at least one second guiding element and at least one second guided element, in positions generally opposite to the first guiding element and to the first guided element, in particular on mutually facing sides of a second wall of the dispenser body and of a second wall of the lid body, respectively;

wherein the first guided element and the second guided element are slidably coupled to the first guiding element and to the second guiding element, respectively.

According to one aspect, the dispenser is characterized in that it comprises at least one constraint element, or a further guiding element, such as a third wall, which is additional to the first walls and to the second walls of the dispenser body and of the lid body and/or to the aforesaid guiding elements and guided elements, the at least one constraint element being provided for guiding better the lid and/or limiting displacements of the guided elements with respect to the guiding elements in a direction generally transverse to a direction of sliding of the lid determined by the sliding guides.

As will emerge more clearly hereinafter, the presence of at least one constraint element enables providing the dispenser in such a way as to eliminate or reduce to a substantial extent the risks of deviations or excessive lateral movements of the lid body, as well as the risks of jamming or excessive friction thereof with the dispenser body, due in particular to shrinkages or anomalous dimensional settling of the moulding material.

According to another aspect, the dispenser is characterized in that:

the facing sides of the first walls are an external side of the first wall of the dispenser body and an internal side of the first wall of the lid body; and the facing sides of the second walls are an internal side of the second wall of the dispenser body and an external side of the second wall of the lid body.

As will emerge more clearly hereinafter, also this solution, alternative or complementary to the solution according to the aforesaid first aspect, enables providing the dispenser in such a way as to eliminate or reduce the risks of jamming or excessive friction between the lid body and the dispenser body and/or the risks linked to anomalous shrinkages of its moulding material and/or facilitates moulding and assembly of parts of the dispenser.

BRIEF DESCRIPTION OF THE DRAWINGS

Further aims, characteristics, and advantages of the present invention emerge clearly from the ensuing detailed description, with reference to the annexed schematic drawings, which are provided purely by way of non-limiting example, and in which:

FIGS. 9 and 10 are perspective views from different angles of the dispenser of FIGS. 7-8, with the aforesaid lid removed;

FIGS. 11 and 12 are perspective views from different angles of the lid of the dispenser of FIGS. 7-8;

FIG. 15 is a top plan view of the dispenser of FIGS. 7-8, with the corresponding lid in an intermediate position;

FIG. 16 is a rear view of the dispenser of FIGS. 7-8;

DESCRIPTION OF PREFERRED EMBODIMENTS OF THE INVENTION

Reference to "an embodiment" or "one embodiment" in the framework of the present description has the purpose of designating that a particular configuration, structure, or characteristic described in relation to the embodiment is comprised in at least one embodiment. Hence, phrases such as "in an embodiment", "in one embodiment", and the like that may be present in various points of the present description do not necessarily refer to one and the same embodiment. In addition, particular conformations, structures, or characteristics may be combined in any adequate way in one or more embodiments, that may even differ from the ones represented. The references used herein are only provided for convenience and hence do not define the sphere of protection or the scope of the embodiments.

It is moreover pointed out that, in the present description and in the attached claims, terms such as "internal side", when referred to a portion, wall, or element of a dispenser body and of a lid body, are meant to designate a side, a face, or a surface of the aforesaid portion, wall, or element that substantially faces an intermediate area of the dispenser, for example at which a receptacle for containing a washing agent opens, this area being preferably at least partially covered by the body of a lid. By terms such as "external side", when also these are used with reference to a portion, wall, or element of a dispenser body and of a lid body, is consequently meant a side, face, or surface of the portion, wall, or element that faces in a direction generally opposite to the direction identified by the "internal side" of the same portion, wall, or element.

Figure 7:
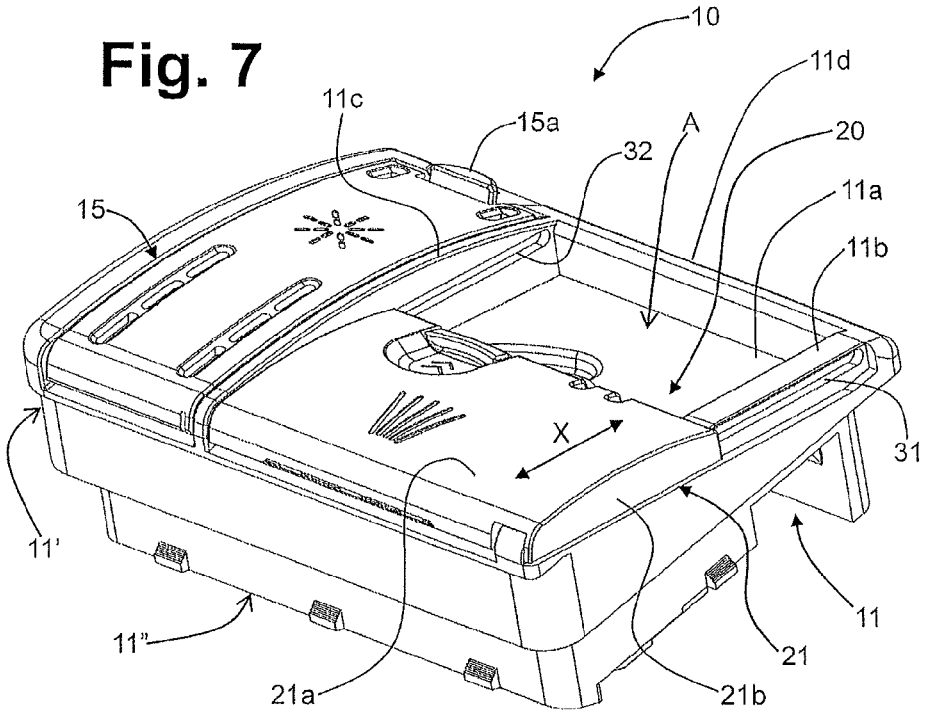
FIGS. 7 and 8 are perspective views of a dispenser according to the invention, with a respective lid in a closed condition and in an open condition, respectively.
Figure 8:
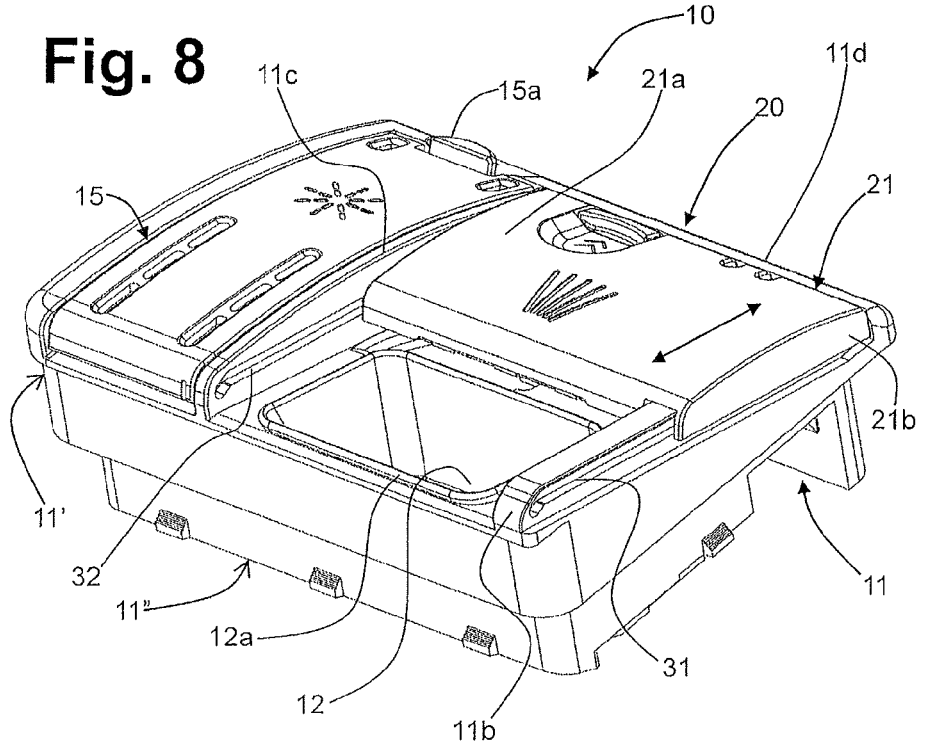

With initial reference to FIGS. 7 and 8, designated as a whole by 10 is a device for dispensing washing agents according to the present invention. The dispenser comprises a dispenser body 11, which is preferably made at least in part of moulded thermoplastic material. In the example illustrated, the dispenser body 11 comprises a front piece or part 11', designed to face or be located in a washing tank, and a rear piece or part 11", preferably designed to be at least in part inserted in an opening of a wall of the tank, the parts 11' and 11" being conveniently moulded with thermoplastic material separately from one another and then joined together, for example via welding. The dispenser can in any case have parts 11', 11" obtained and shaped differently. In the sequel of the present description, generic reference will be made to the dispenser body 11, taking for granted that the characteristics that belong to the present invention refer basically to its front part 11', which defines a front of the dispenser provided with at least one sliding lid.

Defined in an area A of the body of the dispenser 10, here comprising a wall 11*a* of the front of the body itself, preferably but not necessarily a substantially horizontal wall, is a receptacle 12 designed for containing a washing agent, such as a solid washing agent in powder or tablet form (not excluded is the possibility of containing washing substances in some other form, such as a liquid or a gel). The mouth of the receptacle 12 is surrounded by a projecting edge or lip 12*a*, which here rises from the wall 11*a*. At the area A constrained to the body 11 is a lid, designated as a whole by 20 and comprising a lid body 21, obtained by moulding of thermoplastic material, which may be similar to the material constituting the dispenser body 11, for example a polypropylene added with filler material, such as talcum or fibreglass. The lid 20 is movable or slidable in a guided way on the body 11 so that it can displace between a position of closing and a position of opening of the receptacle 12, as shown in FIGS. 7 and 8, respectively. For this purpose, the lid body 21 is constrained with respect to the dispenser body 11 via sliding guides, described hereinafter.

In the example of embodiment illustrated, alongside the area A of the body 11 in which the receptacle 12 is defined, a cover 15 is associated, provided with a corresponding manually operable engagement/release device 15*a*. The cover 15 is preferably hinged to the dispenser body so as to turn according to a generally horizontal axis, but at the same time it may be mounted in a slidable way. The cover 15 is designed to cover a corresponding area located in which is the mouth of a reservoir (not visible) for a second washing agent, such as a liquid agent, for example a rinsing agent. Moreover present in the same area covered by the cover 15 is an outlet opening forming part of a system for dispensing the aforesaid liquid washing agent, and for this purpose the body of the cover 15 preferably has openings or passages designed to enable outflow of the liquid agent towards the inside of the washing tank of the machine, here not represented. In the sequel, it is assumed that the dispenser 10 is fixed to a wall that delimits the tank, for example a wall defined by its door.

The presence of the aforesaid system for dispensing liquid washing agents and of the corresponding reservoir and cover 15 is not necessarily linked to implementation of the present invention, so that these components could even be omitted. On the other hand, also the cover 15 could be slidably constrained to the dispenser body 11, for example using a system of sliding guides of the same type as the one that will be described in detail hereinafter.

The lid body 21 is preferably forced towards the respective condition of opening of the receptacle 12 via elastic means, which comprise, for example, a spring (not represented). Operatively set between the body 11 and the body 21 is a system for blocking/release of the lid 20, which can be controlled by a programmer of the machine (not represented) or else manually. Part of this system, which comprises an engagement device 16 that includes a shaft passing in the body 11, is visible in FIGS. 9 and 10.

As may be seen in FIGS. 9-10 and 13-15, the area A, defined in which is the receptacle 12 and at which the lid 20 is movable, is laterally delimited by portions of the body 11 that rise from a general plane, here substantially identified by the wall 11*a*. More in general, provided in this area A are two portions or walls that are generally opposite or set at a distance apart, designated by 11*b* and 11*c*, which are preferably substantially parallel to each other and with respect to the direction of sliding of the lid, indicated by the arrow X. The opposite portions 11*b* and 11*c* here defined as "walls" may comprise, for example, at least two portions of the body 11 that are in relief with respect to the plane of the area A or to the plane of mouth of the receptacle 12 and are located substantially in the proximity of the two opposite walls or sides of the lid 20.

In the embodiment illustrated, the wall 11*b* is a side end wall in relief of the body 11, and the wall 11*c* is an intermediate wall in relief, here for separation between the area A and the area covered by the tippable cover 15; however, also the wall 11*c* could be an end wall of the front of the dispenser 10, and the wall 11*b* could be an intermediate wall.

The lid body 21 has a main wall 21*a*, the internal side of which generally faces the wall 11*a* of the body 11, as well as a series of side walls, which in the example depart or branch off from the wall 21*a* towards the wall 11*a*. More in general, the lid body 21 has at least two lateral sides or walls, designated by 21*b* and 21*c* in FIGS. 7, 8, 11, and 12, which are preferably generally parallel to each other and with respect to the direction of sliding X of the lid 20, and are hence preferably substantially parallel to the walls 11*b* and 11*c* of the body 11.

FIGS. 9-10 and 11-12 show clearly in different views the various portions of the body 11 and of the body 21 of specific interest for the purposes of implementation of the invention, represented at least by the walls 11*b* and 11*c* of the dispenser body 11 (FIGS. 9 and 10) and by the walls 21*b* and 21*c* of the lid body 21 (FIGS. 11-12).

FIG. 9 shows clearly the external side of the wall 11*b*, as well as the internal side of the wall 11*c*, whereas FIG. 10 shows clearly the internal side of the wall 11*b*, the external side of the wall 11*c* not being instead directly visible, in so far as it is hidden by the lid 15. FIG. 11, instead, shows clearly the external side of the wall 21*b* and the internal side of the wall 21*c* of the body 21, whereas the subsequent FIG. 12 shows the internal side of the wall 21*b* and the external side of the wall 21*c*.

Operative between the walls 11*b* and 21*b*, on one side, and the walls 11*c* and 21*c*, on the other side, are sliding guides, which constrain the lid body 21 with respect to the dispenser body 11. These sliding guides comprise at least one first guiding element and one first guided element, on the mutually facing sides of the walls 11*b* and 21*b*. The sliding guides then comprise at least one second guiding element and one second guided element, on the mutually facing sides of the walls 11*c* and 21*c*.

As has been mentioned, according to an aspect in itself autonomously inventive, the facing sides of the walls 11*b* and 21*b* are the external side of the wall 11*b* and the internal side of the wall 21*b*, respectively, whereas the facing sides of the walls 11*c* and 21*c* are the internal side of the wall 11*c* and the external side of the wall 21*c*, respectively. This solution makes it possible to achieve important benefits in terms of dimensional tolerances allowed for carrying out the step of moulding of the lid body 21 and of the dispenser body 11, as well as in terms of simplification of the moulding equipment and of the corresponding moulding operations.

In one embodiment, such as the one exemplified, at least one guiding element, or each of the guiding elements, comprises a longitudinally extended guiding groove 31, 32, defined on the corresponding side of the corresponding wall 11*b* and 11*c* of the body 11, here represented by the external side and internal side of these walls, respectively. At least one guided element, or each of them, comprises a sliding element 41, 42, which can engage with an aforesaid guiding groove, which is defined at the corresponding side of the corresponding wall 21*b* and 21*c* of the body 21, here represented by the internal side and external side of these walls, respectively.

In a preferred embodiment, such as the one exemplified, the guiding elements provided on the external and internal sides of the walls 11*b* and 11*c*, respectively, each comprise two of the aforesaid grooves 31, 32 preferably substantially axially aligned in the direction of sliding of the lid 20, whereas the guided elements on the internal and external sides of the walls 21*b* and 21*c*, respectively, each comprise a pair of sliding elements 41, 42, here configured substantially as pins projecting from the corresponding wall, preferably cylindrical pins. Preferably, the pins 41, 42 of each pair are defined in end regions of the corresponding wall 21*b* and 21*c*. Obviously possible is an opposite arrangement of the elements that constitute the sliding guides, i.e., with the grooves 31 and 32 formed at least in part on the lid body 21 and with the sliding elements 41 and 42 formed at least in part on the dispenser body 11. Grooves 31, 32 and elements 41, 42 are preferably defined integrally by the bodies 11 and 20, following upon moulding with thermoplastic material of these bodies, but in other embodiments parts set between the bodies 11 and 20 may be provided for the purpose.

Once again from FIGS. 11 and 12 it should be noted how, mounted, with modalities in themselves known, in a region of the lower face of the lid body 21 (corresponding to the internal side of its wall 21*a*) that is comprised between the walls 21*b* and 21*c* is a gasket 50 preferably having a generally quadrangular shape. Advantageously, the gasket 50 has rear extensions 51, as far as a rear transverse wall 21*d* of the body 21, which provide means for cushioning the end of stroke of opening of the lid 20. In particular, the end portions 51*a* of the extensions 51 pass in the wall 21*d* and project beyond the external side thereof. In this way, the projecting portions 51*a* of the extensions 51 may possibly come into contact with a transverse wall 11*d* of the body 11 (see, for example, FIGS. 9-10)—that delimits the area A at the back—when the lid 20 is practically at the end of its stroke of opening. Since the gasket 50 is made of elastic and yieldable material, the aforesaid portions 51*a* make it possible to attenuate the impact between the walls 21*d* and lid. In possible variant embodiments, the attenuation means may be configured as distinct parts with respect to the gasket 50 that are associated to the wall 21*d* or else to the wall 11*d*.

Figure 17:
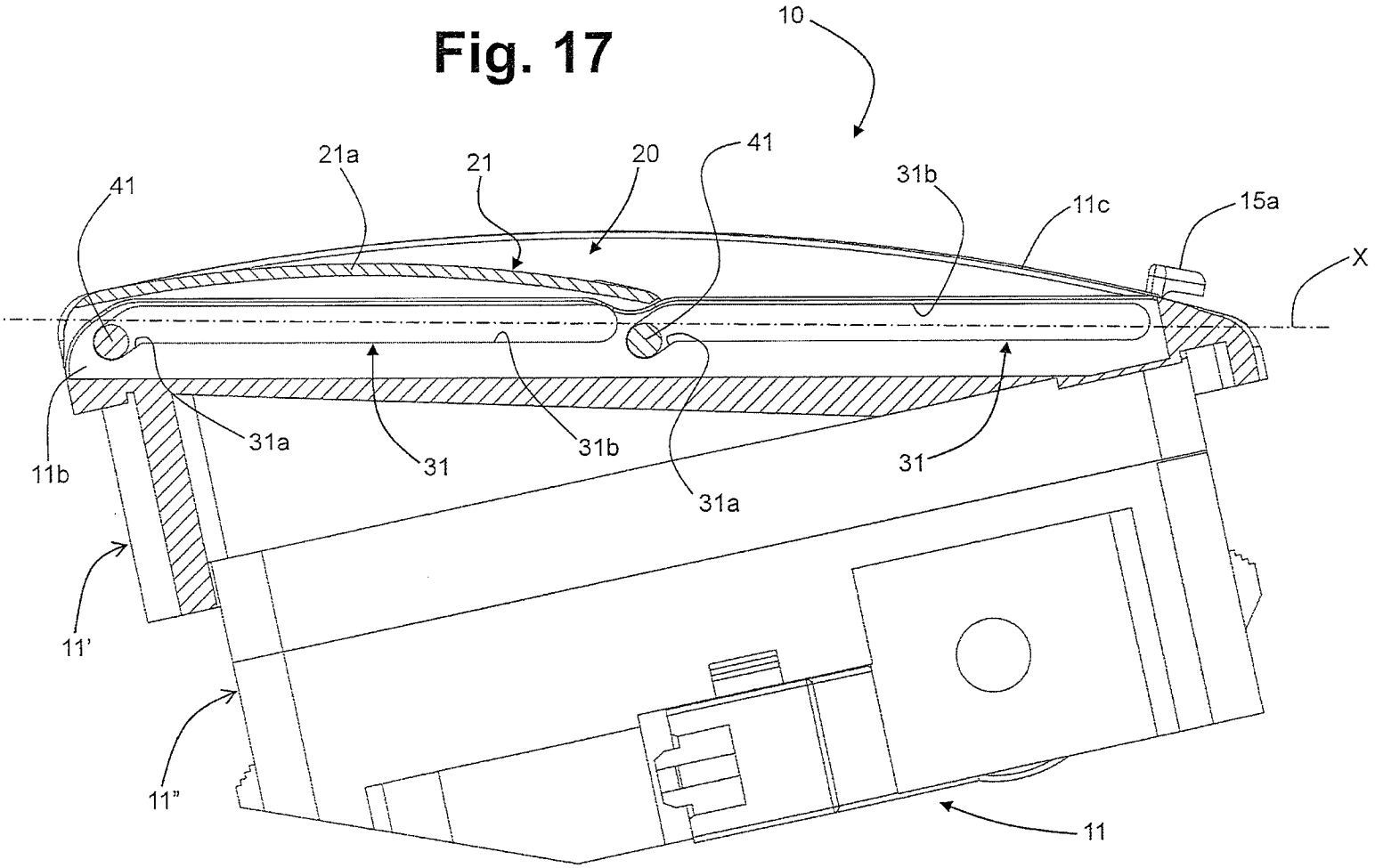
FIGS. 17 and 18 are partial and schematic sections according to the lines XVII-XVII and XVIII-XVIII of FIG. 15, respectively.

The sliding guides, and more in particular the grooves 31 and 32, are preferably configured in such a way that the gasket 50 will come into contact with the edge 12*a* of the receptacle 12 only in a final phase of the movement of the lid 20 from the open position to the closed position. For this purpose, as may be seen in particular in FIG. 17, each groove has at least one respective portion 31*a* that extends at a level different from the level at which the remaining main portion 31*b* of the groove extends. Preferably, the portion 31*a* is an end portion of the groove, which extends at a height or level lower than that of the main portion 31*b*, having as reference the edge 12*a* of the receptacle 12, on which the gasket 50 rests in a fluid-tight way. In FIG. 17 the axis designated by X identifies the direction of extension of the main portions 31*b* of the grooves 31, substantially corresponding to the main direction of sliding of the lid 20. As may be noted, the portions of groove 31*a* are inclined downwards to constitute each a sort of step that is engaged by the pins 41 during the final phase of sliding of the lid 20 towards the closed position, this determining a displacement downwards also of the main wall 21*a* of the body 21, in such a way that in the condition of engagement of the lid 20 the quadrangular part of the gasket 50 is pressed on the edge 12*a* of the receptacle 12.

In the example shown, given that the sliding guides each comprise a pair of grooves 31 and 32 axially aligned at the walls 11*b* and 11*c*, each of these grooves is provided with a respective end portion 31*a*. It will be appreciated, however, that it is also possible to envisage a single uninterrupted groove that replaces the two grooves of an aforesaid pair, the uninterrupted groove presenting an end portion similar to the one designated by 31*a* and presenting moreover, in an intermediate area thereof, an intermediate portion similar to the one designated by 31*a*.

FIG. 17 highlights only the grooves 31 with the elements 41, but provision of the grooves 32 with the elements 42 is similar. It will also emerge clearly that the sliding elements 41, 42, here represented by cylindrical pins, could have a shape different from the one exemplified and that each guiding element—whether it be constituted by a number of aligned grooves or by a single uninterrupted groove—may even have a development at least in part curved or arched.

Figure 13:
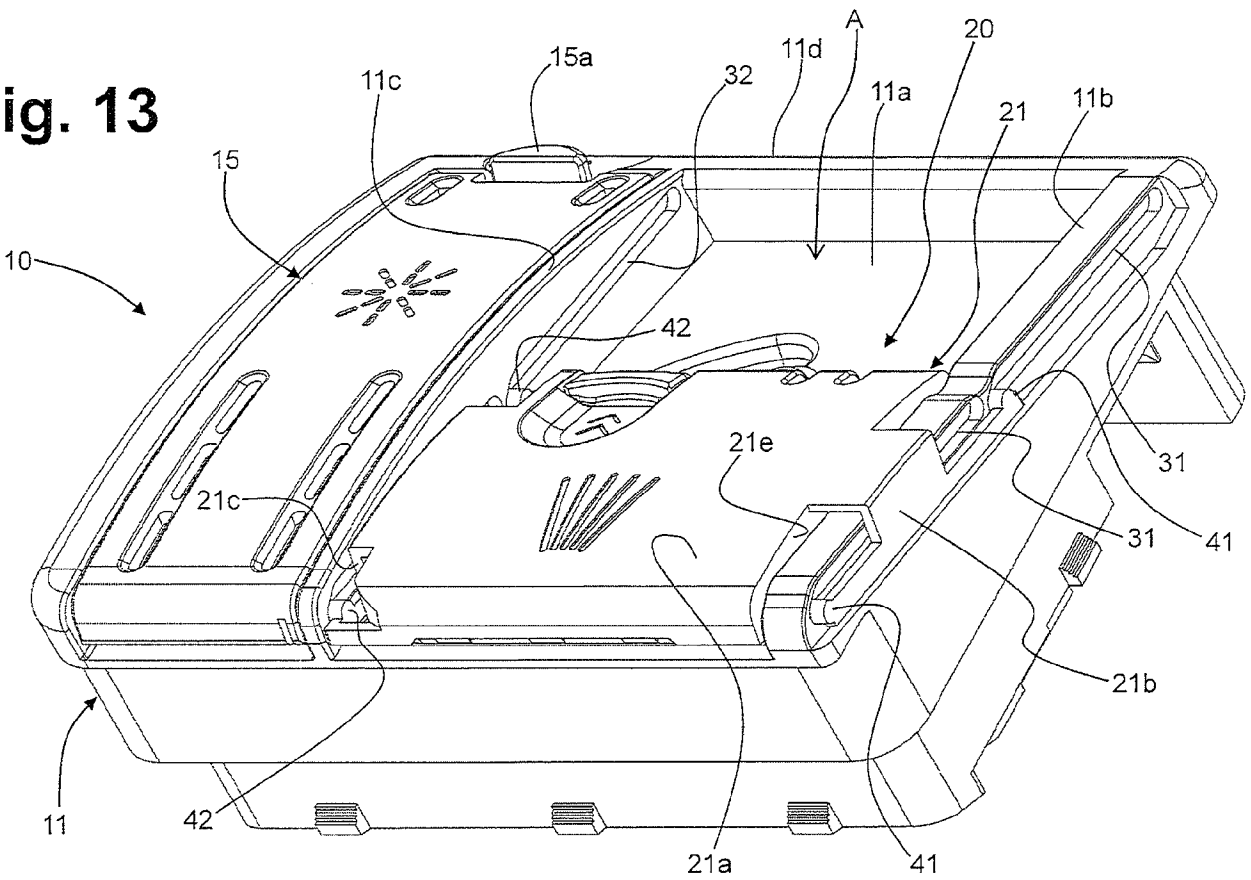
FIGS. 13 and 14 are perspective views similar to those of FIGS. 7-8, at an enlarged scale and with the aforesaid lid partially sectioned.
Figure 14:
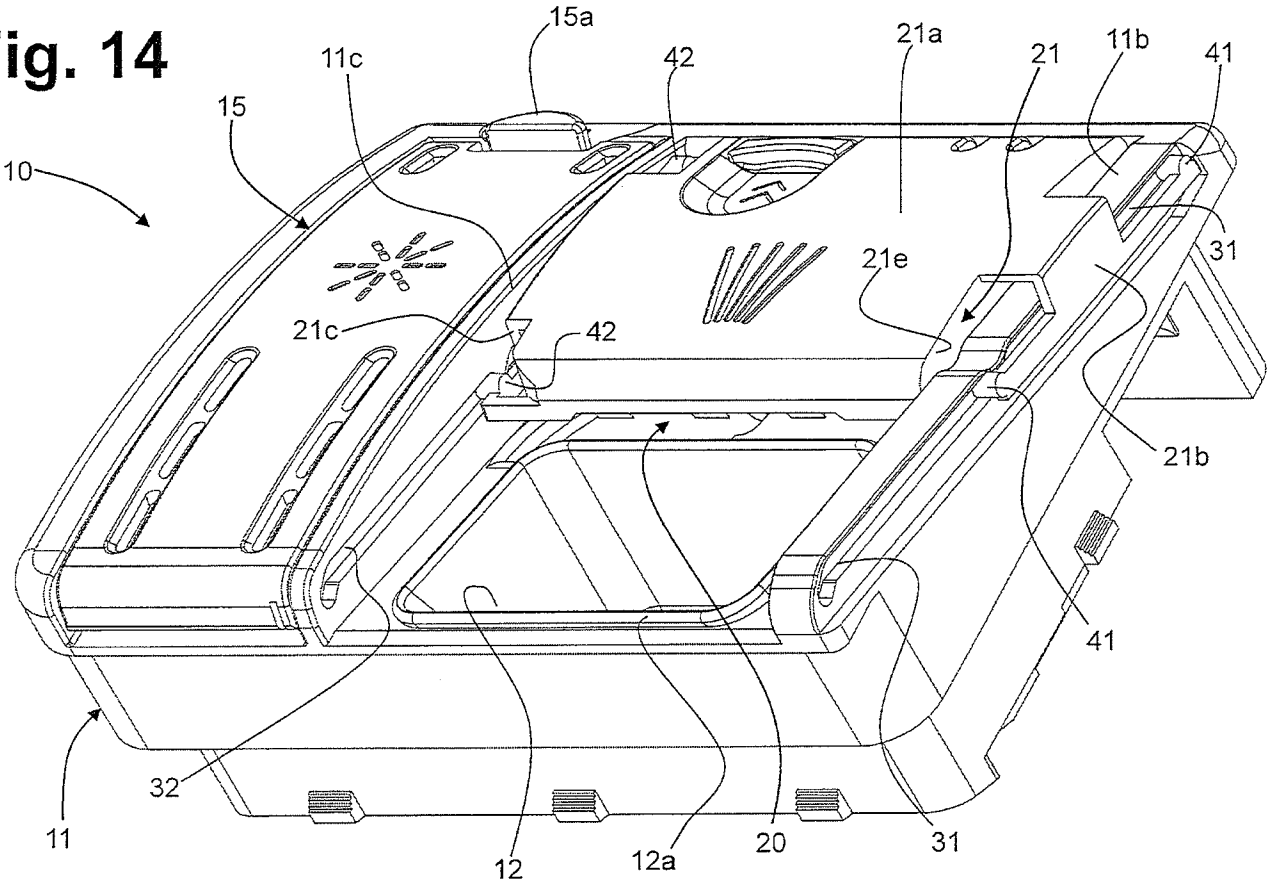

FIGS. 13 and 14 highlight clearly, in partially sectioned views, the conditions of engagement between the various elements of the sliding guides, and in particular some of the pins 41, 42 engaged in the corresponding grooves 31, 32. From these figures, it may be clearly appreciated how also the various facing sides of the walls 11*b* and 21*b* are generally parallel to one another and to the facing sides of the walls 11*c* and 21*c*. It will be appreciated, in particular, how, in the embodiment exemplified, engaged in each groove 31 or 32 is a single pin 41 or 42 of a corresponding pair of pins. From these figures, moreover, it may be noted how preferably provided at the upper face or side of the wall 11*b* is an intermediate depression in order to prevent interference by a rear edge of the lid body 21, when the latter shifts downwards, as may be appreciated from FIG. 17.

Partially and schematically visible in FIG. 16 is part of the actuation system of the dispenser 10, pre-arranged for controlling the system for blocking/release of the lid, which includes the engagement device 16 (here the through shaft mentioned previously is partially visible) and the aforesaid system for dispensing the liquid washing agent, which is also partially visible and is designated by 18. The actuation system may be of any configuration known in the sector, for example comprising a single actuator 19 that is actuated at different times to enable opening of the lid 20 via actuation of the engagement device 16 and dispensing of the liquid washing agent via the system 18. The actuator is preferably an electric actuator, such as an electromagnet, or a thermal actuator.

Figure 18:
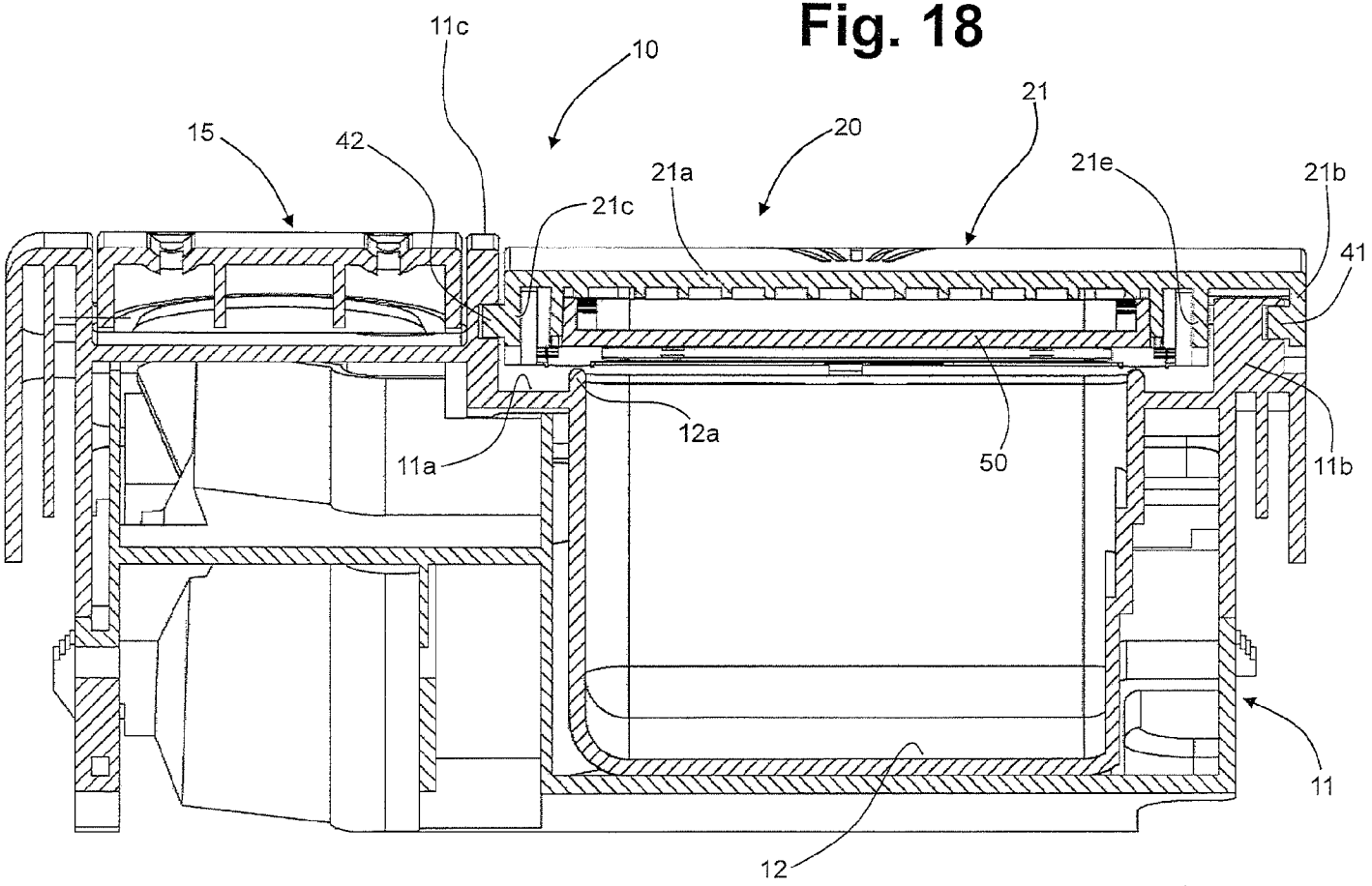
Figure 19:
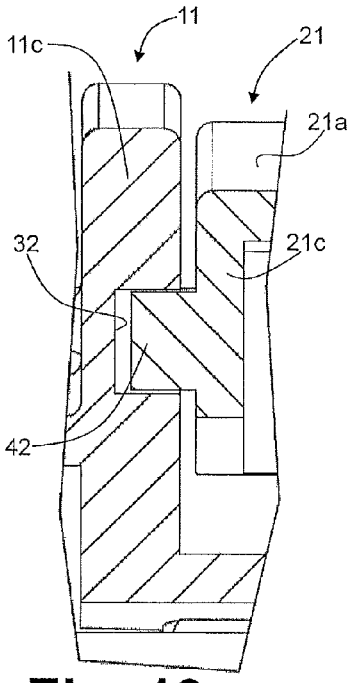
FIGS. 19 and 20 are enlarged details of FIG. 18.
Figure 20:
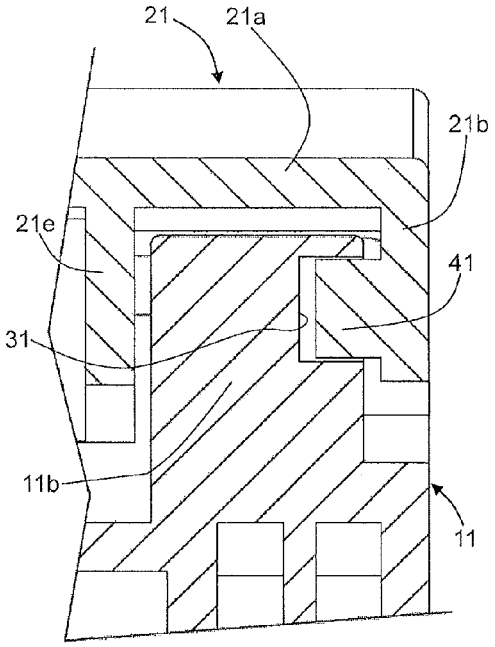

Visible in the cross section of FIG. 18, and in particular in the corresponding details of FIGS. 19 and 20, are the mutually engaged portions of the bodies 11 and 21. FIG. 19 shows clearly one of the pins 42 provided at the external side of the wall 21*c*, engaged in the corresponding sliding groove 32 defined at the internal side of the wall 11*c*. On the other side, in FIG. 20, a pin 41 is visible defined at the internal side of the wall 21*b* and engaged in the corresponding groove 31 defined at the external side of the wall 11*b*.

According to another aspect in itself autonomously inventive, the dispenser 10 comprises at least one constraint element, pre-arranged for limiting some displacements of the guided elements, here represented by the pins 41 and 42, with respect to the guiding elements, here represented by the grooves 31 and 32, in a direction that is generally transverse to the direction of sliding X of the lid 20 as determined by the sliding guides. The at least one constraint element is additional to the various walls 11*b*, 11*c*, 21*b*, 21*c* and to the components of the sliding guides integrated in these walls. As explained previously, this arrangement is extremely advantageous in so far as it makes it possible to predefine moulding tolerances such as to minimize the effects of anomalous shrinkage of the thermoplastic material that constitutes the body 21 and/or the body 11, such as jamming and excessive friction or lateral deviations of the lid 20. The aforesaid constraint element can also be understood as a further guiding element for the lid, aimed at improving precision of displacement thereof.

In a preferred embodiment, the at least one constraint element branches off from one of the dispenser body 11 and the lid body 21 towards the other of the lid body 21 and the dispenser body 11. In the preferred case exemplified in the figures (see in particular FIGS. 11-14, 18 and 20), the constraint element—designated by 21*e*—branches off from the lid body 21, and in particular from the internal side of its wall 21*a*, in the direction of the dispenser body 11, in particular towards its wall 11*a*, and has at least one surface generally facing the internal side of the wall 21*b* of the body 21, and hence generally facing the internal side of the wall 11*b* of the body 11.

Advantageously, in one embodiment, such as the one exemplified, the constraint element 21*e* is constituted by a further portion or wall of the lid body 21 that is preferably generally parallel to the walls 21*b* and 21*c* and is in a position relatively close to one of them (here to the wall 21*b*). This further wall 21*e* may be clearly seen in FIGS. 11 and 12. As will emerge hereinafter, the at least one constraint element does not necessarily have to be constituted by a continuous wall, as in the preferred case illustrated, given that its functions can also be obtained via interrupted walls, localized reliefs, projecting pins, etc.

As may be appreciated also from FIG. 20, the wall 21*e* of the body 21 defines, together with the wall 21*b* and with a portion of the wall 21*a*, a sort of housing that surrounds or embraces the wall 11*b* of the body 11 on three sides, and in particular its external, upper and internal sides. Engaged in this housing is the wall 11*b*, which provides therewith a sort of rail. This arrangement, together with the fact that the pins 41 are coupled to the corresponding grooves 31, makes it possible to guide movement of the lid 20 in an extremely precise way, even in the case of anomalous shrinkage of the material, as will be seen hereinafter. This arrangement moreover prevents excessive lateral movements of the pins 41, 42 in the corresponding groves 31, 32, in a direction transverse to the direction of sliding X, thereby preventing any lateral deviation of the lid 20 during its travel. The wall 21*e* also prevents the pins 41, 42 from sliding laterally out of the corresponding grooves 31, 32, in the aforesaid transverse direction.

Figure 21:
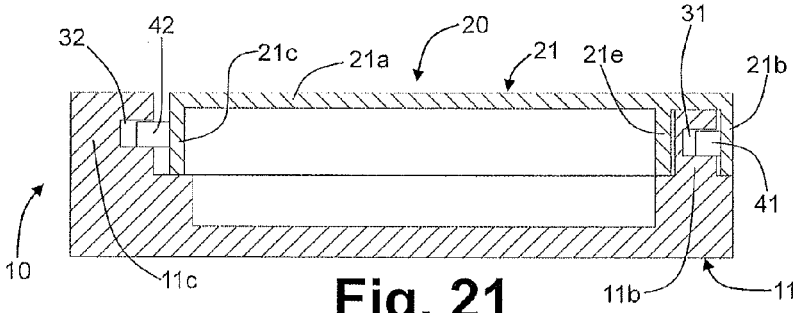
FIG. 21 is a schematic cross section similar to those of FIGS. 1 and 2, aimed at exemplifying a condition of optimal shrinkage of the thermoplastic material constituting parts of a dispenser according to the invention.

FIG. 21 illustrates in an extremely schematic way a dispenser 10 according to the invention, in a condition in which the lid body 21 has been moulded with an optimal dimension of the product, i.e., with a predefined or expected shrinkage of the corresponding material, in the absence of anomalies of shrinkage of the thermoplastic material during moulding and without any deformation.

The solution of envisaging the constraint element 21*e* presents the advantage of enabling increased production tolerances as compared to the known art, i.e., of envisaging in the design stage even increased distances or clearances between the facing walls bearing the sliding guides 31-41, 32-42, without this determining in itself anomalous operation of the dispenser after assembly between the bodies 11 and 21.

Figure 1:
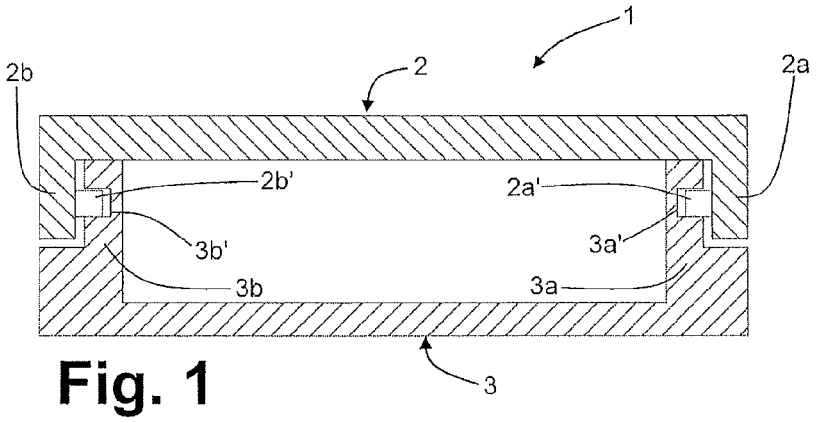
FIGS. 1 and 2 are schematic cross sections of dispensers according to known solutions.
Figure 2:
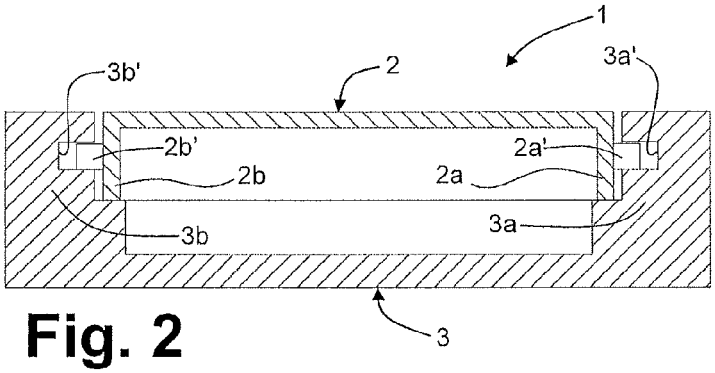
Figure 3:
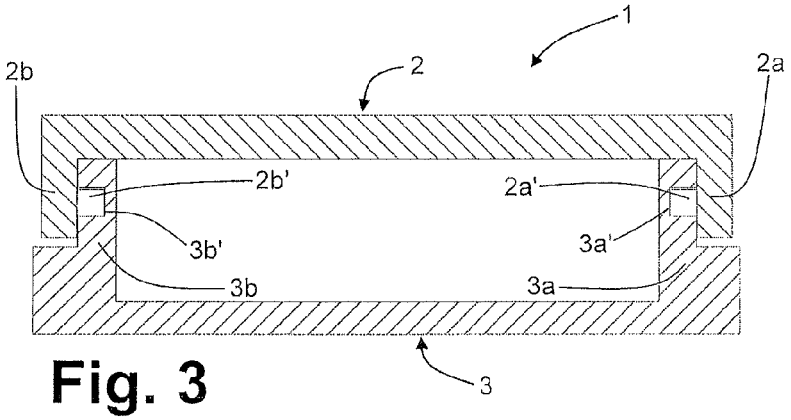
FIGS. 3 and 4 are schematic cross sections similar to those of FIG. 1, aimed at exemplifying conditions of anomalous shrinkage of a thermoplastic material constituting parts of a first dispenser of a known type.
Figure 4:
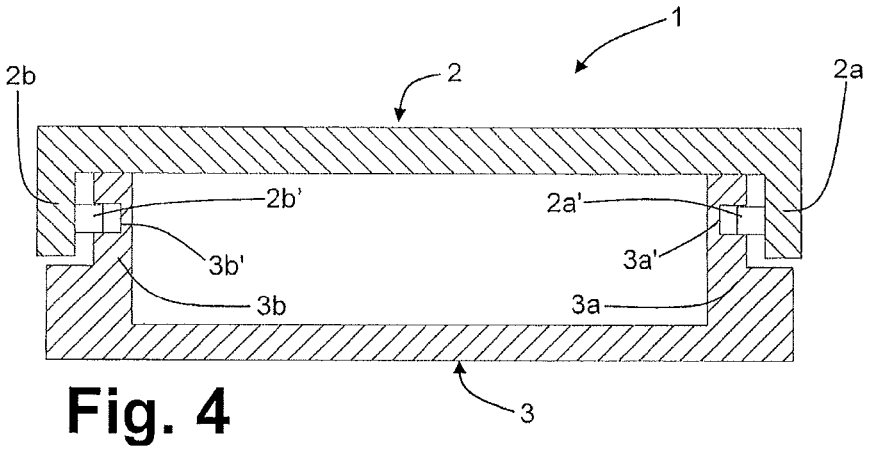
Figure 5:
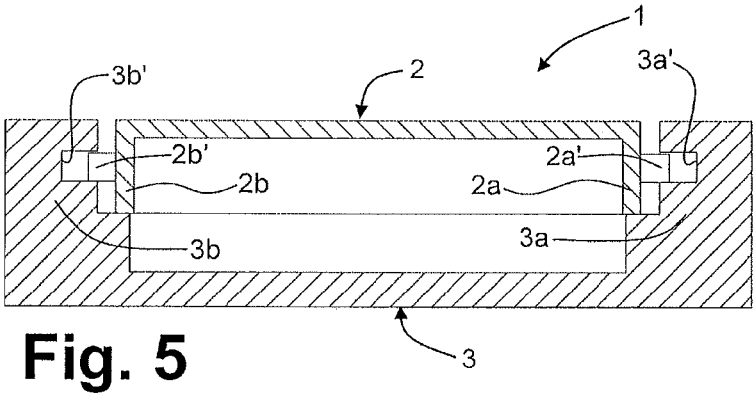
FIGS. 5 and 6 are schematic cross sections similar to those of FIG. 2, aimed at exemplifying conditions of anomalous shrinkage of a thermoplastic material constituting parts of a second dispenser of a known type.
Figure 6:
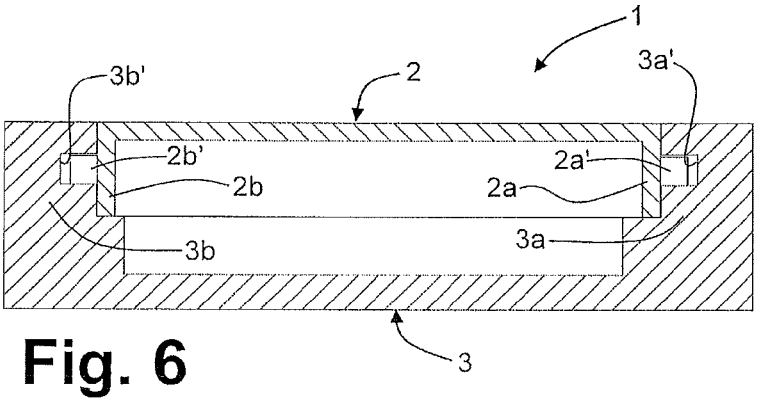
Figure 22:
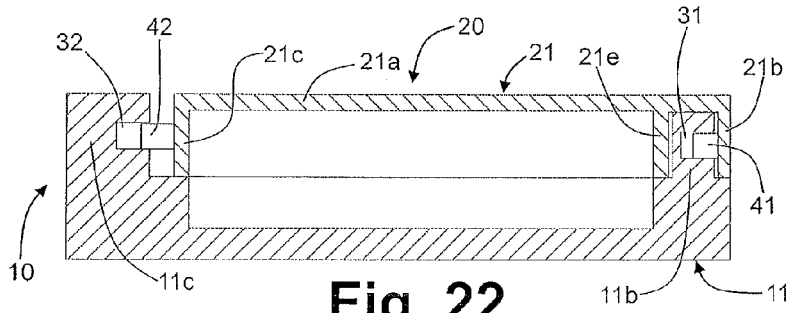
FIGS. 22 and 23 are schematic cross sections similar to those of FIG. 21, aimed at exemplifying conditions of anomalous shrinkage of the thermoplastic material constituting the aforesaid parts of a dispenser according to the invention.
Figure 23:
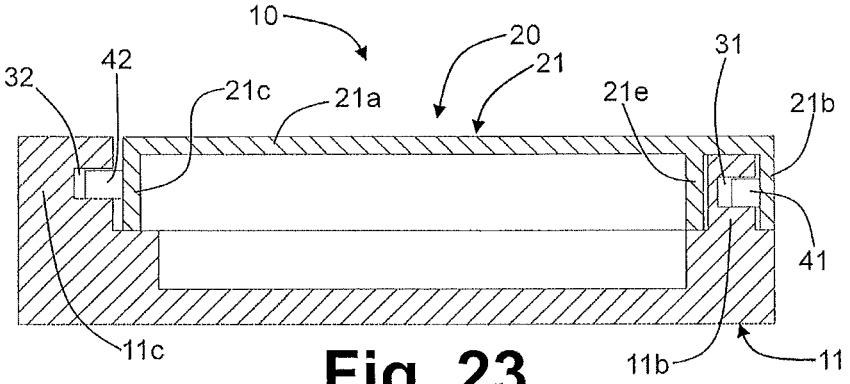

For example, from a comparison between FIG. 21 and FIGS. 1 and 2, which correspond to the known dispensers, it may be noted how the invention affords greater tolerances in the design stage, i.e., makes it possible to envisage larger distances between the facing sides of the walls to which the sliding guides 31-41 and 32-42 are associated, considering the fact that the body 21 is in any case guided well thanks to the aforesaid housing, delimited by the constraint wall 21*e*. FIG. 22 highlights an anomalous condition, of excessive shrinkage of the thermoplastic material constituting the lid body 21. It will be appreciated that in this case only the pins 42 are loose in the respective guiding grooves 32, with the lid body 21 that can in any case be withheld and well guided on the opposite sides, thanks to the presence of the constraint wall 21*e*. FIG. 23 highlights, instead, an anomalous condition of insufficient shrinkage of the thermoplastic material. It will be appreciated that, in any case, the pins 41, 42 and the walls 21*b*, 21*c* of the lid body 21 are not in any case forced in the guiding grooves 31, 32 and against the walls 11*b*, 11*c* of the dispenser body 11, thanks to the greater distances between the walls or the greater dimensional tolerances allowed in the design stage.

In order to understand the advantages of this aspect, there may be considered the reduced shrinkage and/or deformation of the thermoplastic material in the limited area that is comprised between the wall 21*b* and the constraint wall 21*e*, as compared to the increased shrinkage and/or deformation that are determined considering the entire width of the lid body 21; consider, for example, a lid body 21 and a dispenser body 11 made of polypropylene, a material whereby a shrinkage of approximately 2% is expected.

As has been explained, in practice there may arise anomalies in the percentage of shrinkage and/or of structural deformation, due to various factors. Given these anomalies there could thus be obtained a dimensional tolerance that ranges between ±0.5% and ±1%, or even greater, for the lid body and for the dispenser body. Considering a variation of ±1% there may hence be the case of a lid body 21 that has a tolerance of +1% (low shrinkage) and a dispenser body that has a tolerance of −1% (higher shrinkage), or vice versa, with a total resulting tolerance of coupling between the two bodies in question given by the combination of their tolerances that would induce problems of jamming or deviation of the lid, according to the cases.

With reference to FIGS. 1 and 2, now consider a lid body 2 in which the internal sides (FIG. 1) or external sides (FIG. 2) of the walls 2*b* and 2*c* are, for example, at 80 mm from one another and a dispenser body 3 in which the external sides (FIG. 1) or internal sides (FIG. 2) of the walls 3*b* and 3*c* are at a distance slightly greater than the aforesaid 80 mm, for example 80.5 mm. With the clearances typical of the known art previously referred to, and considering a total tolerance of 2%, there would be obtained a dimensional variation of approximately 1.6 mm of the lid body 2, which in one case (walls 2*b*, 2*c* of the lid body at a greater distance and walls 3*b*, 3*c* of the dispenser body at a smaller distance) would lead to jamming of the lid body, and in the opposite case (walls 2*b*, 2*c* of the lid body at a smaller distance and walls 3*b*, 3*c* of the dispenser body at a greater distance) would lead to a lateral deviation of the lid during its stroke.

To come now to the invention, in the design stage it is possible to establish wider production tolerances, i.e., greater distances between the facing sides of the walls that define the sliding guides 31-41 and 32-42, as compared to the known art, thanks in any case to the presence of the constraint element 21*e* that enables guiding of the lid. Consider just the portion of the lid body 21 comprised between the wall 21*b* and the constraint wall 21*e*: between these two walls that guide the lid there may be defined in the design stage an even relatively modest distance, for example of approximately 3.3 mm, with a thickness of the wall 11*b* set in between for example of 3 mm (with a relative distance or clearance of 0.3 mm).

The aforesaid distance of 3.3 mm is approximately 1/24 of the total width of the lid body (80 mm nominal), where to a variation of 2% there would hence correspond a dimensional variation of just 0.066 mm in the distance between the two walls 21*b* and 21*e* in question. Similar considerations may apply to the thickness of the wall 11*b*, which is 3 mm, where to a variation of 2% there would hence correspond a dimensional variation of just 0.06 mm in thickness. Considering thus the aforesaid albeit reduced distance or clearance of 0.3 mm between the walls 21*e*, 21*b* of the lid body 21 and the wall 11*b* of the dispenser body 11, also in the worst case where the aforesaid maximum dimensional variations or tolerances of 0.066 mm and 0.06 mm add up, for a total of 0.126 mm, there would still be obtained a distance or clearance between the walls of 0.174 mm that enables sliding of the lid.

It follows that—albeit in the presence of the known large dimensional variations in the entire lid body—the solution proposed in any case guarantees reduced dimensional variations in the area that effectively guides movement of the lid 20 such as not to adversely affect the movement of the lid itself. In this way, between the facing sides of the walls 11*b*, 21*b* and 11*c*, 21*c* there can be defined in the design stage even larger distances as compared to the known art, such as to prevent any risk of jamming or anomalous lateral movements even in the most unfavourable conditions of shrinkage of the thermoplastic material constituting the components involved.

The solution of providing one sliding guide 31-41 between the external side of the wall 11*b* and the internal side of the wall 21*b* and the other sliding guide 32-42 between the internal side of the wall 11*c* and the external side of the wall 21*c*, when envisaged, evidently enables a further increase of the design tolerances, in the perspective of preventing any risk of jamming or deviation even in the most unfavourable moulding conditions (walls 21*b*, 21*c* at a greater distance and walls 11*b*, 11*c* at a smaller distance or else walls 21*b*, 21*c* at a smaller distance and walls 11*b*, 11*c* at a greater distance). This solution also entails advantages linked to simplification of production of the moulds and/or execution of moulding of at least some parts of the dispenser. The known solutions referred to in the introductory part of the present description imply the use of moulds and corresponding parts of mould that are relatively complicated. This regards in particular the so-called "slides", i.e., those parts of mould that are to be moved via carriages and that in the known solutions cited must be used for defining the grooves belonging to the sliding guides for the lid. Given that, in the known solutions, the aforesaid grooves must be defined in undercuts made in the external sides (U.S. Pat. No. 5,884,821 A) or else in the internal sides (DE102005004098 A) of opposite walls of the dispenser body, the corresponding moulding equipment imposes the use of two respective slides moved by corresponding distinct carriages that move in opposite directions, which by their nature are complex and enable relatively reduced values of undercut to be obtained. Given that, in preferred embodiments of the invention the guiding grooves 31, 32 open in one and the same direction, this affords a relative simplification of at least some of the slides and/or of the corresponding carriages. Possibly, in one embodiment, it is also possible to use a single slide that defines the guide grooves 31, 32, and thus with movement of just one part of mould with the corresponding carriage.

FIGS. 24-28 illustrate possible variant embodiments of the invention, specifically in relation to the arrangement of the constraint element, in particular for the purposes described in relation to the previous examples, such as for guiding better the lid and/or for preventing its excessive lateral deviation or movement, facilitating the design and/or production of the dispenser, and reducing the anomalies due to different shrinkage of the thermoplastic material.

Figure 24:
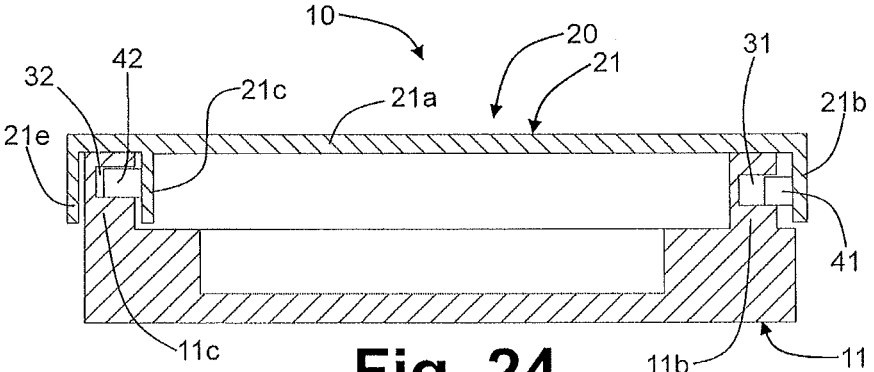
FIGS. 24-28 are schematic cross sections similar to those of FIG. 21, aimed at exemplifying possible variant embodiments of the invention.

In the case of the embodiment of FIG. 24, the wall 21*e* that provides the constraint element is formed in the body 21 in such a way that a surface thereof, here its intern surface, faces towards the external side of the wall 11*c* of the dispenser body 11 (in the example, the constraint wall 21*e* forms a side of the lid body 21). Of course, such an embodiment implies that alongside the wall 21*e* (on the left, as viewed in FIG. 24) no elements of hindrance are envisaged, such as the cover 15 previously described, or else that a seat is provided for enabling sliding of the constraint element 21*e* in the body 11.

Figure 25:
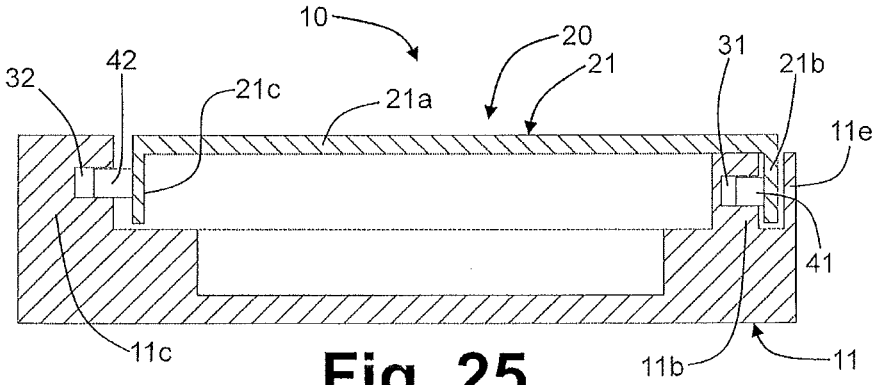

FIG. 25 illustrates, instead, the case where the constraint element, here represented by the wall designated by 11*e*, is defined in the dispenser body 11 and rises from this, alongside the lid body 21. As may be appreciated, in this case, the wall 11*e* has at least one surface or side, here the internal side, that faces the external side of the wall 21*b* of the lid body 21.

Figure 26:
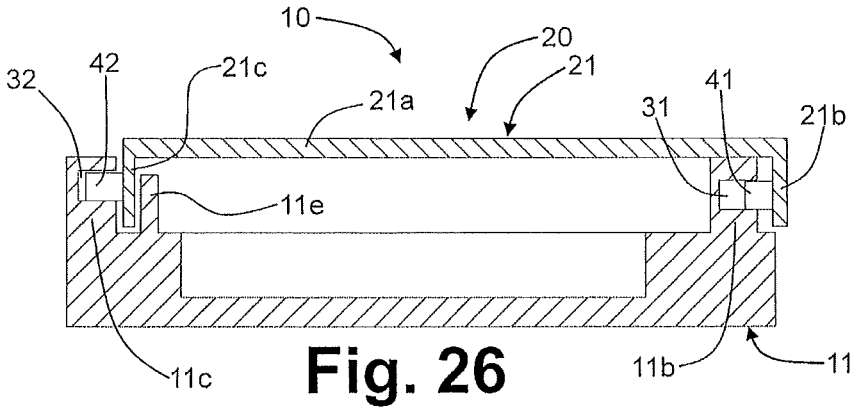

In the variant of FIG. 26 the constraint element, here represented by the wall designated by 11*e* of the dispenser body 11, is, instead, defined by the opposite side with respect to FIG. 25 and in an area covered by the lid body 21 (i.e., in an intermediate position with respect to the walls 21*b* and 21*c*), in such a way that its external side faces the internal side of the wall 21*c* of the lid body 21.

Figure 27:
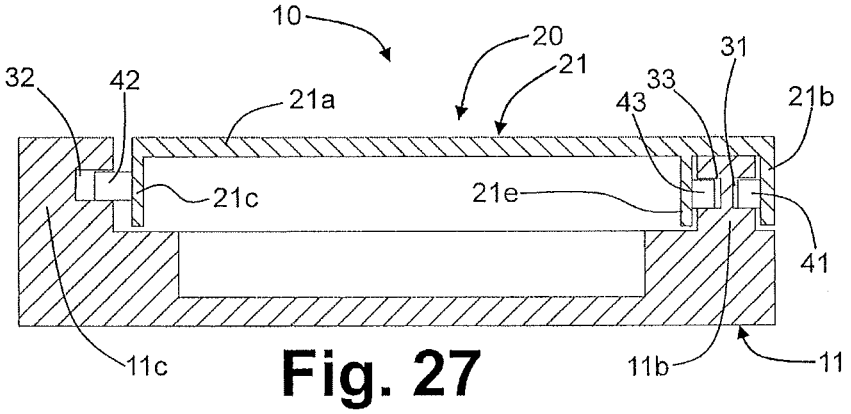

FIG. 27 illustrates a particularly advantageous embodiment of the invention, according to which the sliding guides provided between the dispenser body 11 and the lid body 21 comprise at least one third guiding element in which at least one third guided element is slidably coupled. In the case illustrated, the third guided element, comprising, for example, one or two pins 43 of the same type as those previously designated by 41 and 42, is at the external side of the constraint wall 21*e*, i.e., the side that faces the internal side of the wall 11*b* of the body 11, where the third guiding element is provided, for example represented by one or two guiding grooves 33 of the same type as the ones previously designated by 31 and 32.

According to a further variant (not shown) a lid configuration is provided similar to the known configuration of FIG. 2, albeit with greater distances or predefined tolerances with respect to the dispenser body, where a constraint wall on the lid 2 is provided, substantially located on the outside with respect to the walls 2*a* or 2*b*, i.e., in at a side of the lid body, with the internal side of the constraint wall facing the external side of the wall 3*a* or 3*b*, respectively (hence with a configuration that may be as a whole similar to that of FIG. 27), possibly with a third guide groove on the external side of the wall 3*a* or 3*b*, respectively, for a guided element associated to the internal side of the aforesaid constraint wall. This configuration can thus be understood as an improvement of the solution according to the German prior-art document described above, i.e., with the addition of the constraint wall that makes it possible to achieve the advantages of the present invention described.

Figure 28:
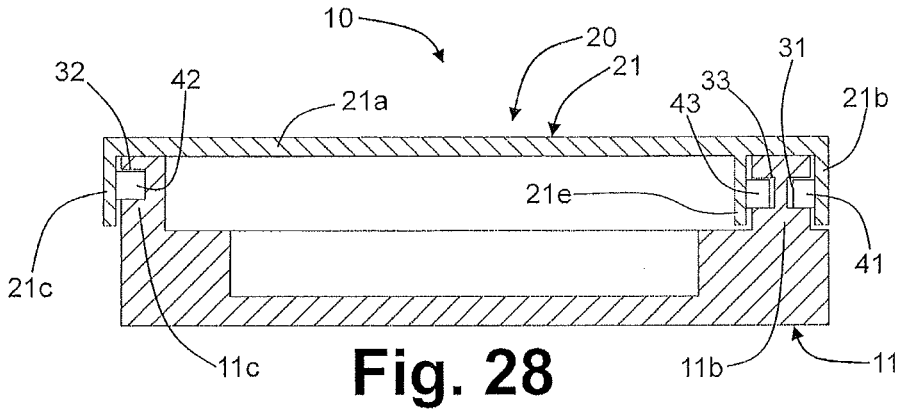

FIG. 28 relates to a configuration where the side walls 21*b* and 21*c* of the lid each have the internal side facing the external side of the respective wall 11*b* and 11*c* and where the constraint wall 21*e* is in an intermediate area with respect to the two walls 21*b* and 21*c*, with its external said facing the internal side of the wall 11*b*. In this case, the wall 21*e* can have on the external side a third guided element 43, coupled in a corresponding guiding groove 33 provided on the internal side of the wall 11*b*. Such a configuration can thus be understood as an improvement of the solution according to the U.S. prior-art document referred to above (see FIG. 1), i.e., with the addition of the further constraint or intermediate-guide wall, which makes it possible to achieve the advantages of the present invention described.

Obviously possible are other combinations of positioning of the constraint wall and/or of the sliding guides on the lid body and on the dispenser body with respect to the ones represented, some of which are indicated in the annexed claims, and among which there may be included a version of device with at least one constraint wall on the body of the lid 20 and at least one constraint wall on the body of the dispenser 10.

It will finally be appreciated that the constraint elements 21*e* and 11*e* do not have necessarily to be constituted by continuous portions or walls of the bodies 21 and 11, it being possible for them to consist of walls that have intermediate interruptions or to be constituted by one or more localized elements, for example in the form of pins or projections. Also the walls 21*b* and 21*c* bearing the pins 41 and 42 could be interrupted walls, with at least two separate parts of wall set at a distance apart from one another that each include a corresponding pin 41 or 42. Such a conformation of the constraint elements and/or of the walls bearing the pins or guides may prove advantageous for the purpose of reducing the risks of trapping of foreign substances (such as grains of powder of washing agent or residue of dirt), in particular providing appropriate interruptions or openings for discharge of the aforesaid foreign substances.

It is clear that numerous variants may be made by the person skilled in the branch to the dispenser described by way example, without thereby departing from the scope of the invention as defined by the ensuing claims.

The invention has been described with reference to the examples of embodiment in which parts of the sliding guides of the lid 20 (such as the grooves 31, 32) and/or at least one constraint element (such as the wall 21*e*) are present on a stationary body of the dispenser 10 (such as the body 11) or else on the lid body 21. In possible variant embodiments not represented, at least part of the guide (grooves or pins) and/or at least one constraint element operating as described previously can be defined in one or more members set between a stationary body of the dispenser and the lid, for example movable transmission or connection elements, also articulated to the aforesaid stationary body, such as, for example, a crank element.

In this perspective, in the definition "dispenser body" present in various parts of this description and of the ensuing claims there must be understood as being comprised also fixed or movable elements that are operatively set between a stationary part of the dispenser and its lid, for example, for constraining or guiding the movement of the lid itself with respect to the aforesaid stationary part.

The invention claimed is:

1. A washing agent dispenser for machines for washing, comprising a dispenser body with at least one receptacle for containing a washing agent, at least one lid having a lid body mounted in a guided way relative to the dispenser body so as to be movable between a position of closing and a position of opening of the at least one receptacle, and sliding guides between the dispenser body and the lid body, wherein a first wall and a second wall of the dispenser body are generally opposite to each other, and a first wall and a second wall of the lid body are generally opposite to each other, wherein the sliding guides comprise:

a first guiding element and a first guided element; and a second guiding element and a second guided element, in generally opposite positions with respect to the first guiding element and to the first guided element;

wherein the first guided element and the second guided element are slidably coupled to the first guiding element and to the second guiding element, respectively;

wherein at least one of the dispenser body and the lid body also comprises at least one constraint element, which is additional to said first walls and said second walls and which is arranged for limiting displacements of the guided elements with respect to the guiding elements in a direction that is generally transverse to a sliding direction of the lid defined by the sliding guides.

2. The dispenser according to claim 1, wherein:

the first guiding element and the first guided element are at mutually facing sides of the first wall of the dispenser body and of the first wall of the lid body, respectively;

the second guiding element and the second guided element are at mutually facing sides of the second wall of the dispenser body and of the second wall of the lid body, respectively;

the mutually facing sides of the first walls are an external side of the first wall of the dispenser body and an internal side of the first wall of the lid body; and the mutually facing sides of the second walls are an internal side of the second wall of the dispenser body and an external side of the second wall of the lid body.

3. The dispenser according to claim 1, wherein the at least one constraint element branches off from one of the dispenser body and the lid body towards the other one of the lid body and the dispenser body, and wherein at least one of:

the at least one constraint element branches off from the lid body and has at least one surface generally facing one of an internal side of the first wall of the dispenser body and an external side of the second wall of the dispenser body;

the at least one constraint element branches off from the dispenser body and has at least one surface that generally faces one of an external side of the first wall of the lid body and an internal side of the second wall of the lid body.

4. The dispenser according to claim 1, wherein the at least one constraint element comprises a further wall of the lid body, respectively of the dispenser body, which is at least approximately parallel to at least one of the first walls and of the second walls of the dispenser body and of the lid body.

5. The dispenser according to claim 1, wherein;

the at least one constraint element branches off from the lid body and defines, together with the first wall or the second wall of the lid body, respectively, and with an upper wall portion of the lid body that is generally transverse and contiguous to said first wall or said second wall of the lid body, a housing that surrounds on at least three sides the first wall, respectively the second wall, of the dispenser body; or else the at least one constraint element branches off from the dispenser body and defines, together with the first wall or the second wall f the dispenser body, respectively, and with an upper wall portion of the dispenser body that is generally transverse and contiguous to said first wall or said second wall of the dispenser body, a housing that surrounds on at least three sides the first wall, respectively the second wall, of the lid body.

6. The dispenser according to claim 1, wherein the sliding guides comprise at least one third guiding element to which at least one third guided element is slidably coupled.

7. The dispenser according to claim 6, wherein the at least one third guiding element and the at least one third guided element comprise at least one of:

a third guiding element or a third guided element associated to the at least one constraint element;

a third guided element at a surface of the at least one constraint element that branches off from the lid body, which surface faces the internal side of the first wall of the dispenser body, at which a third guiding element is provided;

a third guided element at a surface of the at least one constraint element that branches off from the lid body, which surface faces the external side of the first wall of the dispenser body, at which a third guiding element is provided;

a third guiding element at a surface of the at least one constraint element that branches off from the dispenser body, which surface faces the external side of the first wall of the lid body, at which a third guided element is provided;

a third guiding element at a surface of the at least one constraint element that branches off from the dispenser body, which surface faces the internal side of the second wall of the lid body, at which a third guided element is provided.

8. The dispenser according to claim 1, wherein:

at least one guiding element, or each guiding element, comprises one of a longitudinally extended groove and a projecting sliding element defined at a corresponding side of the corresponding wall of the dispenser body; and at least one guided element, or each guided element, comprises the other one of a projecting sliding element and a longitudinally extended groove defined at the corresponding side of the corresponding wall of the lid body.

9. The dispenser according to claim 8, wherein at least one guiding element, or each guiding element, comprises one of two said longitudinally extended grooves and two said projecting sliding elements, respectively; and at least one guided element, or each guided element, comprises the other one of two said projecting sliding elements and two said longitudinally extended grooves.

10. The dispenser according to claim 8, wherein at least one groove, or each groove, has a groove portion that extends at a level different from a level on which a main portion of the same groove extends.

11. The dispenser according to claim 1, wherein mounted at a lower face of the lid body is a gasket and wherein at least one of:

the gasket is mounted in a region of said lower face that is comprised between the at least one constraint element and the first wall or the second wall of the lid body;

the sliding guides are configured in such a way that the gasket comes into contact with an upper edge of the receptacle in an end phase of the movement of the lid from the position of opening to the position of closing;

the gasket defines at least one end-of-stroke dampening element of the lid from the position of closing to the position of opening.

12. The dispenser according to claim 1, wherein:

the first guiding element and the first guided element are at mutually facing sides of the first wall of the dispenser body and of the first wall of the lid body, respectively;

the second guiding element and the second guided element are at mutually facing sides of the second wall of the dispenser body and of the second wall of the lid body, respectively;

the mutually facing sides of the first walls are an external side of the first wall of the dispenser body and an internal side of the first wall of the lid body; and the mutually facing sides of the second walls are an external side of the second wall of the dispenser body and an internal side of the second wall of the lid body.

13. The dispenser according to claim 1, wherein:

the first guiding element and the first guided element are at mutually facing sides of the first wall of the dispenser body and of the first wall of the lid body, respectively;

the second guiding element and the second guided element are at mutually facing sides of the second wall of the dispenser body and of the second wall of the lid body, respectively;

the mutually facing sides of the first walls are an internal side of the first wall of the dispenser body and an external side of the first wall of the lid body; and the mutually facing sides of the second walls are an internal side of the second wall of the dispenser body and an external side of the second wall of the lid body.

14. A washing agent dispenser for machines for washing, comprising a dispenser body with at least one receptacle for containing a washing agent, at least one lid having a lid body mounted in a guided way relative to the dispenser body for being movable between a position of closing and a position of opening of the at least one receptacle, and sliding guides between the dispenser body and the lid body, wherein a first wall and a second wall of the dispenser body are generally opposite to each other and a first wall and a second wall of the lid body are generally opposite to each other, wherein the sliding guides comprise:

a first guiding element and a first guided element, at mutually facing sides of the first wall of the dispenser body and of the first wall of the lid body, respectively;

a second guiding element and a second guided element, in generally opposite positions with respect to the first guiding element and to the first guided element, at mutually facing sides of the second wall of the dispenser body and of the second wall of the lid body, respectively;

wherein the first guided element and the second guided element are slidably coupled to the first guiding element and to the second guiding element, respectively;

wherein:

the mutually facing sides of the first walls are an external side of the first wall of the dispenser body and an internal side of the first wall of the lid body;

the mutually facing sides of the second walls are an internal side of the second wall of the dispenser body and an external side of the second wall of the lid body;

and wherein at least one of the dispenser body and the lid body also comprises at least one constraint element, which is additional to said first walls and said second walls and which is arranged for preventing uncoupling of the guided elements from the guiding elements.

15. A household machine for washing, comprising a washing agent dispenser according to claim 1.

16. The dispenser according to claim 2, wherein the mutually facing sides of the first walls are generally parallel to each another and to the mutually facing sides of the second walls.

17. The dispenser according to claim 10, wherein said groove portion is an end groove portion that extends at a lower level with reference to an upper edge of the receptacle.

18. The dispenser according to claim 14, wherein the mutually facing sides of the first walls are generally parallel to each another and to the mutually facing sides of the second walls.

* * * * *